United States Patent [19]

Lambertson

[11] 4,184,289

[45] Jan. 22, 1980

[54] TWIN-GATE TYPE TURNSTILE

[75] Inventor: William A. Lambertson, Staten Island, N.Y.

[73] Assignee: Perey Manufacturing Co., Inc., New York, N.Y.

[21] Appl. No.: 940,345

[22] Filed: Sep. 6, 1978

[51] Int. Cl.[2] ..... E06B 11/08

[52] U.S. Cl. ..... 49/42; 49/46

[58] Field of Search ..... 49/42, 43, 44, 46

[56] References Cited

U.S. PATENT DOCUMENTS

| | | | |
|---|---|---|---|
| 1,342,253 | 6/1920 | Collins | 49/46 |
| 2,258,896 | 10/1941 | Kelker | 49/42 |

*Primary Examiner*—Kenneth Downey

*Attorney, Agent, or Firm*—Watson, Leavenworth, Kelton & Taggart

[57] ABSTRACT

A twin-gate type turnstile in which the central barrier thereof is provided in the form of vertically staggered rows of arms extending between an opposed pair of posts, with at least terminal lengths of the fixed arms, i.e., the length portions thereof adjacent the posts extend in an arcuate course so that during the rotation of the rotors, the arms of same pass through the fixed rows of arms at about mid-length of such fixed arms thereby lessening the likelihood that a user could accidentally enter into or be caught in the space between the rotor arms and the fixed arms of the barrier if the user by mistake sought to transit the turnstile in the wrong direction or failed to exit the turnstile at the proper location.

1 Claim, 4 Drawing Figures

TWIN-GATE TYPE TURNSTILE

BACKGROUND OF THE INVENTION

Twin-gate type turnstiles are known in the art, for example, such form of turnstile being described in U.S. Pat. 2,258,896. Such type of turnstile includes two turnstile rotors which rotate between opposite end barriers and a central barrier to permit two avenues of ingress or egress through the turnstile. The spacing of the axes of rotation of the two rotors is such that during the course of their rotation there is a common region in which the arms of the respective rotors overlap and pass through each other as well as through the fixed arms of the central barrier. The central barrier described in said patent and which is commonly employed in the art, is provided by two vertically spaced rows of fixed arms extending between an opposed pair of posts with the arms extending in a widening course from the posts to a maximum widening on an imaginary line extending between the two rotor axes. The arms of the two fixed rows of arms face each other and the terminal lengths of these fixed arms, that is the length sections adjacent the fixed posts follow a relatively straight line course. In the turnstile type disclosed in said patent, the overall plan outline of the central barrier is in the shape of a diamond. This results in the crossing of the fixed barrier arms by the arms of the rotors at or near the ends or extremes of the fixed barrier arms, that is at locations close to the fixed posts. As a consequence, it is possible for a person walking through the turnstile to follow the rotor arms of one row right up to the time they pass through the fixed barrier arms so that the next row of arms on the rotor can arrive at a position in which they sufficiently reduce the opening or exit space between the tip ends of the arm of said next row and the barrier to inhibit or prevent the person egressing the unit. Due to the generally unidirectional rotational operation of the rotor, it thus would become difficult, if not virtually impossible, for the user to work his way out from the entrapment. Furthermore, the spacing of the arms in the two rows of fixed arms in the turnstile disclosed in said patent is such that the arms of one row are in planar alignment with the arms of the other row, and the rotating arms of the two rotors intervene successively vertically spaced ones of the fixed arm pairs. This means that very little clearance space exists between the fixed arms and the arms of the rotors so it is possible for a user during passage through the unit to catch his hand or an article such as a purse, between a rotor arm or the barrier element arm.

SUMMARY OF THE INVENTION

The present invention is concerned with improvements in turnstiles and particularly a turnstile of the twin-gate type, that is one having two rotor elements rotatable about spaced apart vertical fixed axes, the radially directed arms of one rotor overlapping with those of the other during the course of their rotation. As as conventional with such turnstile, end barrier means can be provided in the form of a vertical or horizontally disposed grid of generally arcuate profile past which the tip ends of the arms of the rotors pass, and there also being provided a central barrier disposed intermediate the fixed vertical axes through which the arms of the rotors overlappingly pass. In accordance with the invention, the central barrier is comprised of two rows of fixed arms extending between two fixed posts, such fixed posts being disposed laterally of an imaginary line extending between the two axes of rotations and located on a line which bisects such imaginary line. The arms of the fixed rows extend from the posts in a widening course which reaches maximum widening at said imaginary line, so that from one post in the direction of the other, there is a widening course of each arm to maximum at the imaginary line and then the following of the arm of a converging inwardly course towards the other post. The arms of the two rows of fixed arms face each other but unlike prior constructions are vertically staggered with respect to each other so that the fixed arms of one row of such fixed arms are in planar alignment with corresponding arms of the turnstile rotor remote from said one row. This means that a greater spacing can be provided between the fixed arms and the rotating arms on the rotors to lessen the likelihood that a user could catch his hand or package or purse or the like when passing through the turnstile.

Further in accordance with the invention, the arms of the fixed rows constituting the central barrier at least along the lengths thereof adjacent the fixed posts follow an arcuate course. In consequence, the rotor arms which pass between the fixed arms tend to cross the fixed central barrier arms near the center of the latter. As a result, the user in entering the turnstile is not likely to either enter or be caught between the rotor arm and the fixed barrier in a fashion as would result in his becoming trapped between the fixed barrier and the rotor arms. Since the user in entering this improved form of turnstile thereby normally encounters a greater exposure of fixed arms than in prior forms of such type of turnstile, the fixed arms which preferably follow an arcuate course along their full lengths tend to direct him away from the center of the turnstile and toward the intended passage course at the end of the structure thereby to prevent the occurrence of entrapment between the rotor arm and the fixed barrier arms.

The invention accordingly comprises the features of construction, combination of elements, and arrangements of part which will be exemplified in the construction hereinafter set forth and the scope of the invention will be indicated in the claims.

BRIEF DESCRIPTION OF THE DRAWINGS

A fuller understanding of the nature and objects of the invention will be had from the following detailed description taken in conjunction with the accompanying drawings, in which.

Throughout the following description, like reference numerals are used to indicate like parts in the drawings.

DESCRIPTION OF THE PREFERRED EMBODIMENTS

Figure 1:
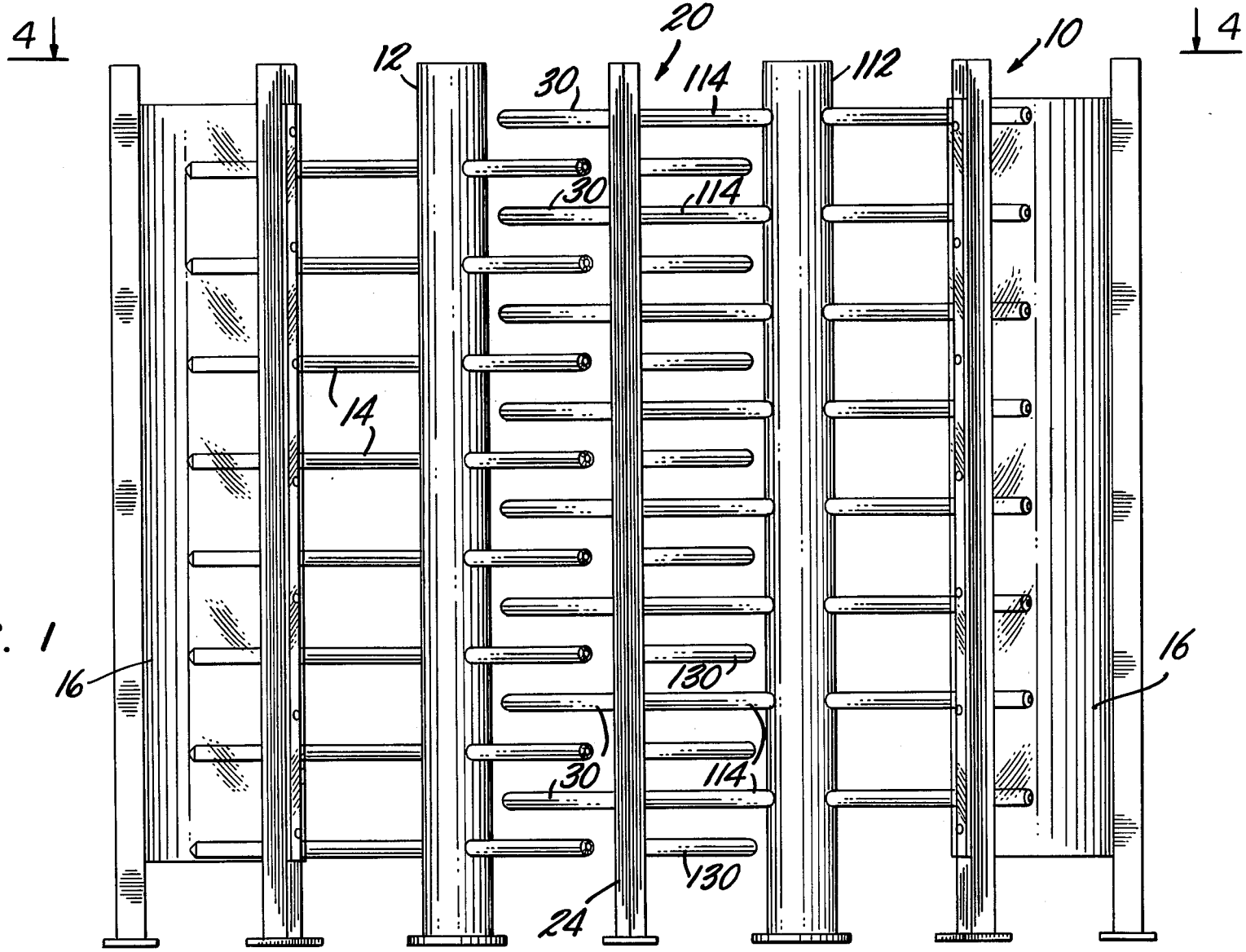
FIG. 1 is an elevational view of an improved turnstile constructed in accordance with the present invention.
Figure 4:
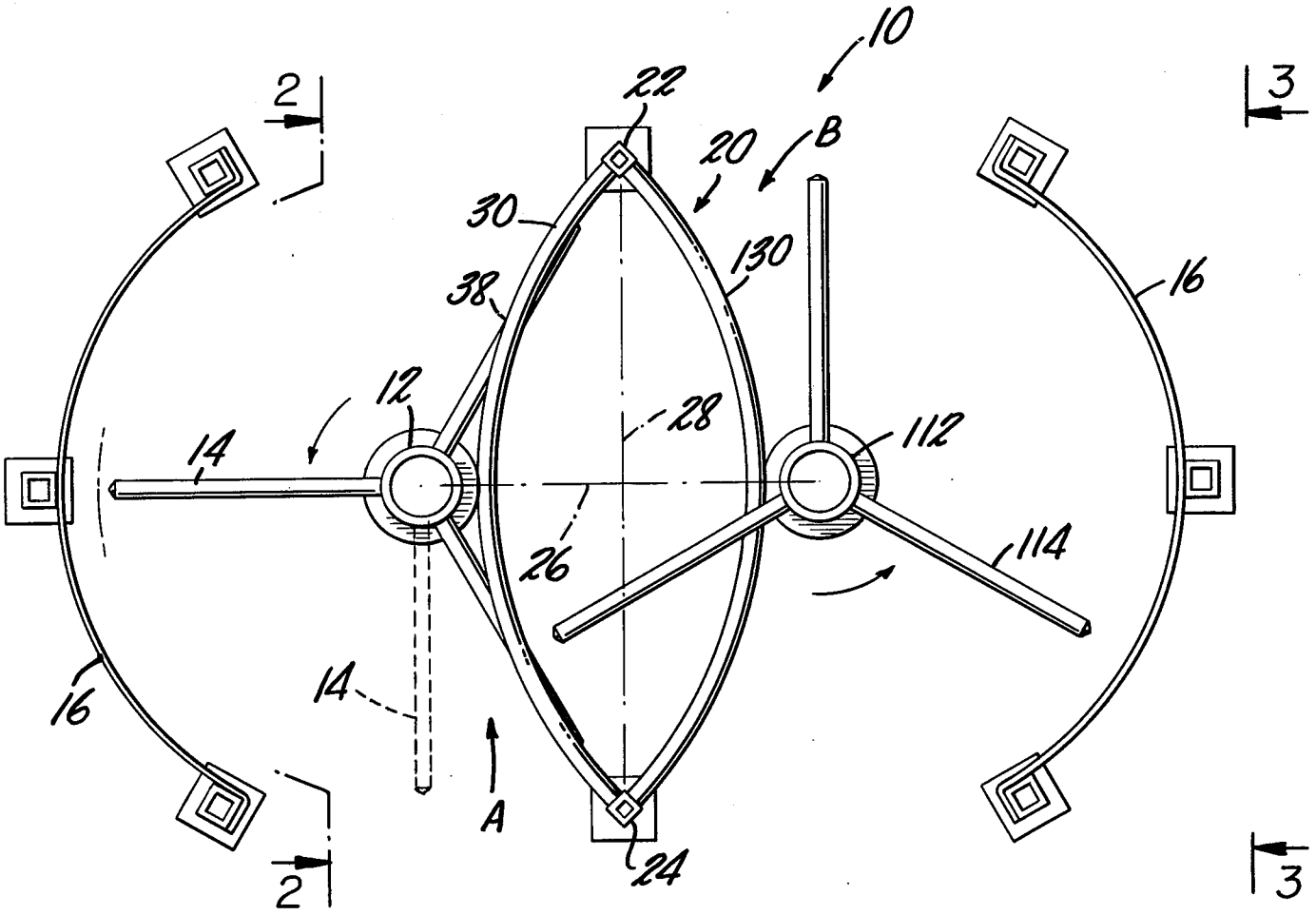
FIG. 4 is a top plan view of the turnstile shown in FIGS. 1-3 as taken along the line 4—4 in FIG. 1.

Referring to FIGS. 1 and 4 of the drawings, the turnstile 10 of the invention is a two-gate type having a left rotor 12 and a right rotor 112, the rotors carrying the respective vertical rows of radially directed rotor arms 14, 114, the rows of arms on the rotor being circularly spaced one from another. The rotors are as noted spaced a distance apart and are rotatable about fixed axes, the spacing between the axes and the vertical staggering of the arms 14, 114 being such that the arms intersect in a common region of overlapping travel at the center of the structure.

The structure is of elongated character and is conventional, is provided with end barrier 16 in this embodiment the barriers being transparent, arcuate shaped enclosures which the tip ends of the rotor arms pass in close adjacency during rotation of same. The structure also includes a central barrier shown generally at 20 and which comprises fixed posts 22, 24 spaced laterally outwardly of an imaginary line 26 extending between the axes of rotor rotation and located on a line 28 which bisects the imaginary line. Extending between the posts 22, 24 are two rows of fixed arms, the right row of arms 130 being associated with rotor 14 and the left row of arms 30 being associated with rotor 114.

Figure 2:
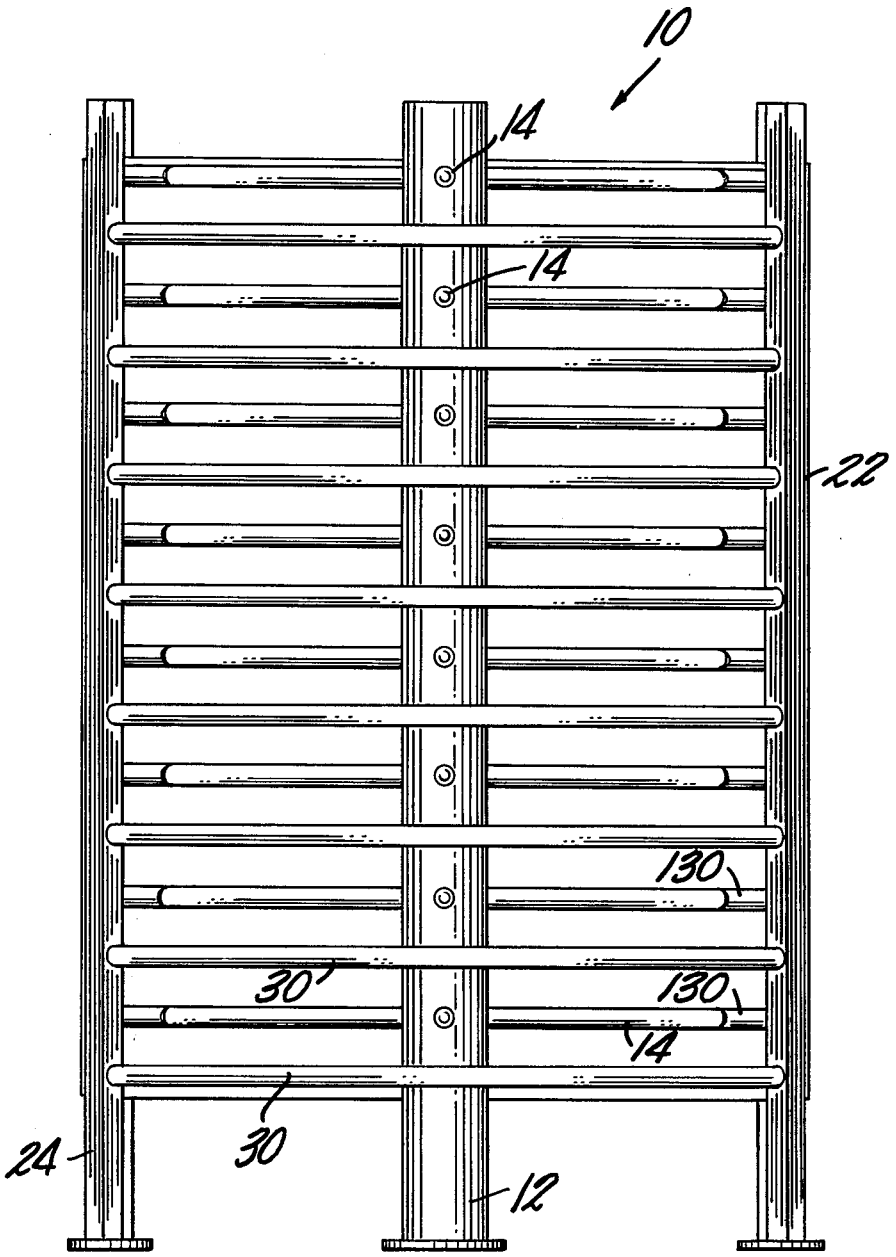
FIGS. 2 and 3 are respective views taken along the lines 2—2 and 3—3 in FIG. 4.
Figure 3:
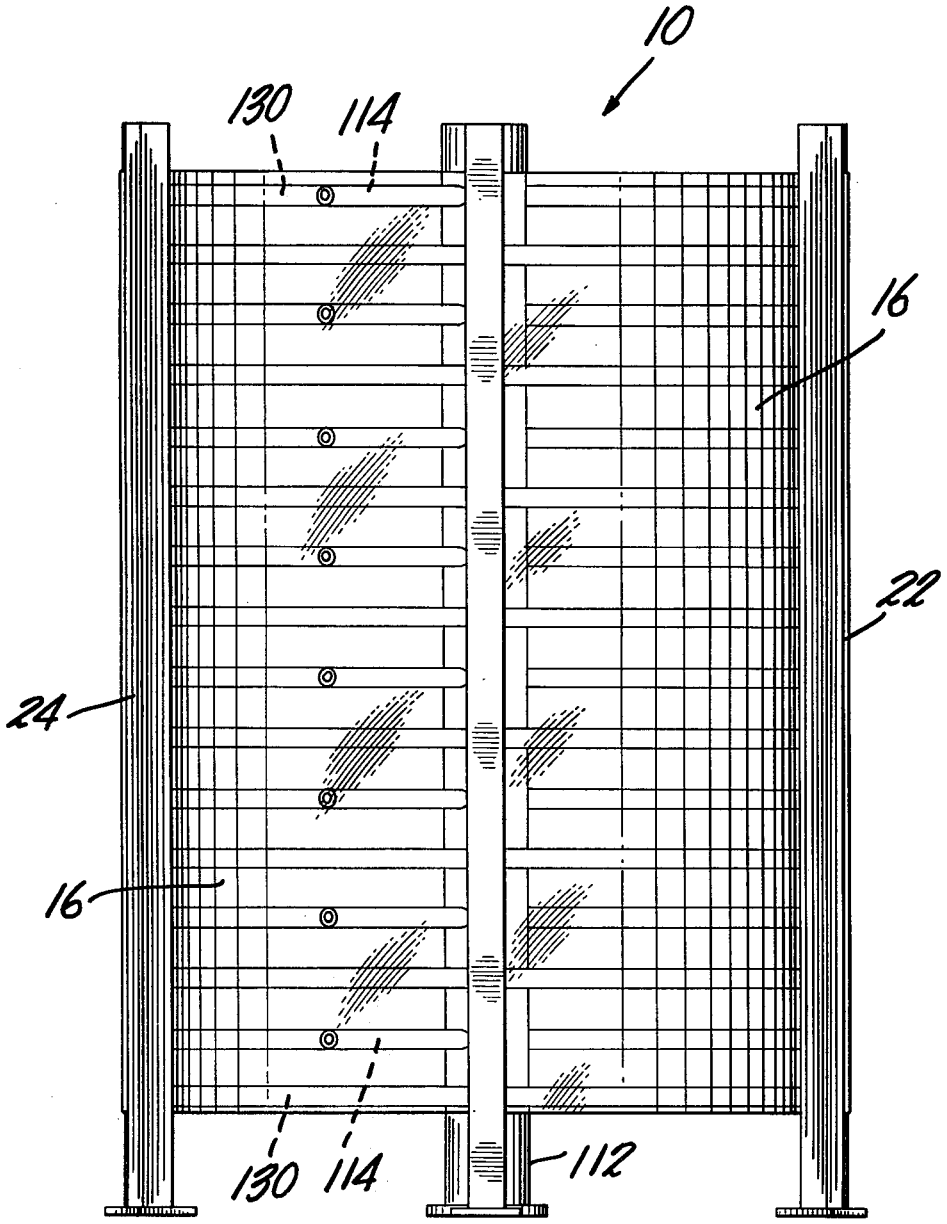

The arms 30 of one row of fixed arms are vertically staggered with respect to the arms 130 in the other row and as seen in FIGS. 1–3 the rotor arms pass in between the fixed arms in the region of overlap. Moreover and as is provided by the present invention, the fixed arms extend from the posts 22, 24 in a widening course from one post that reaches a maximum at the imaginary line 26 from whence of course each arm follows a narrowing course as it extends to the opposite post. The arms 30, 130 face each other and at least portions of the length of each arm adjacent the posts are arcuate in profile. Preferably each fixed arm is arcuate over its entire length. As a consequence, the arms of the rotors enter the fixed arms at about mid-length of the latter or at 38 so that there exists almost no possibility of a rotor arm closing behind a person in a space between the rotor arm and a fixed arm. In other words, the passage of the rotor arm between the fixed arms at mid-length of the latter means that a user cannot accommodate himself in the space remaining between the fixed arms and the rotor arms as the latter moves toward the former, e.g., to a position as shown in dashed lines in FIG. 4. Nor could a user enter the space A without being able to withdraw if necessary. The same is also reflected in the position of rotor 112 in FIG. 4 which shows space B as providing ample egress space for a user while precluding the user mistaking that such space is intended for entry.

As noted above the fixed arms of each row are staggered vertically in respect of those in the other row with the arms of one row, e.g., arms 30 in planar alignment with arms 114 of the rotor remote from said row of arms 30. This is an important feature of the invention in the manner of effecting spacing between the arms of the central barrier and the rotor arms. Known designs stagger the vertical location of the two sets of rotor arms and the barrier element arm. That is, none of the rotor arms or barrier elements are in the same plane. In order to keep a reasonable spacing between the set of rotor arms on one rotor (using 5″ as a standard) it is necessary to locate the sets of rotor arms in relation to the barrier elements in such a position that they will be extremely dangerous to the user; they would be too closely spaced for passenger safety. If, for example, rotor arms and central barrier elements are 1″ diameter (the very minimum standard size possible) were used with a spacing between the arms of 5″ (the minimum standard dimension for an impenetrable turnstile) this would leave only 1″ clearance between the rotor arms and central barrier arms on either side. This 1″ could very well cause a user of the turnstile to catch his hand or any other article between the rotor arm and the barrier element. The turnstile of the invention sets the rotor arms of one rotor at the same plane as the barrier element for the opposite or remotely located rotor. In this case, making use of rotor arms and central barrier arms of 1″ diameter with a 5″ rotor arm spacing, there would be a clearance of 2″ between the rotor arms and central barrier arms.

The present invention thus provides a twin-gate rotor turnstile of safer character than known types.

What is claimed is:

1. In a turnstile structure of the twin-gate type having a pair of turnstile rotors rotatable about vertical axes, each rotor carrying vertical rows of radial arms thereon, the rows being circularly spaced about the rotor axis, the spacing between said axes and the vertical spacing of the arms of one rotor with respect to those of the other rotor being such that during the course of rotation of said rotors the arms thereof transit a region between said axes in which the arms of the respective rotors overlap, barrier means at the longitudinal extremes of said structure, and a fixed central barrier in the region between said axes and comprising a pair of fixed posts spaced laterally outwardly of an imaginary line extending between said rotor axes and disposed at opposed locations on a line which bisects said imaginary line, and two rows of vertically spaced arms fixed to said posts, the arms of each row of fixed arms extending between said posts in a course which widens in a direction away from said posts to a point of maximum widening at said imaginary line, the arms on said rotors during rotation of same passing between said fixed arms, the improvement wherein at least the portions of the lengths of said fixed arms adjacent said posts follow an arcuate course, the arms of one of said fixed rows of arms being vertically staggered relative to the fixed arms of the other row of fixed arms, with the fixed arms of one of said rows of fixed arms facing the other row and being in planar alignment with the arms of the rotor remote from said one row.

* * * * *